US006076432A

United States Patent [19]

Chang

[11] Patent Number: 6,076,432

[45] Date of Patent: Jun. 20, 2000

[54] REVERSIBLE RATCHET SCREWDRIVER

[76] Inventor: Yueh Chang, No. 64, Tu-Cheng Rd., Ta-Li City, Taichung Hsien, Taiwan

[21] Appl. No.: 09/365,762

[22] Filed: Aug. 3, 1999

[51] Int. Cl.[7] ..... B25B 13/46

[52] U.S. Cl. ..... 81/61; 81/439; 81/63.1

[58] Field of Search ..... 81/60, 61, 62, 81/63, 63.1, 63.2, 438, 439, 490, 177.2, 177.4

[56] References Cited

U.S. PATENT DOCUMENTS

| | | | |
|---|---|---|---|
| 5,685,204 | 11/1997 | Braun | 81/63.1 |
| 5,687,820 | 11/1997 | Lin | 192/43.2 |
| 5,875,692 | 3/1999 | Lin | 81/58.3 |
| 5,967,003 | 10/1999 | Lin | 81/58.3 |

*Primary Examiner*—Timothy V. Eley
*Assistant Examiner*—Dung Van Nguyen
*Attorney, Agent, or Firm*—Bacon & Thomas

[57] ABSTRACT

A reversible ratchet screwdriver, which includes a top handle shell and a bottom handle shell fastened together, a ratchet mechanism mounted inside the handle shells, the ratchet mechanism including a substantially triangular flat block, a long tube and a short tube formed integral with top and bottom sides of the triangular flat block and longitudinally communicated with each other, three pawls respectively coupled between the triangular flat block and a toothed portion at the bottom handle shell, and three spring elements respectively connected between the triangular flat block and the pawls to force the pawls into engagement with the toothed portion at the bottom handle shell, and a double-head socket for mounting with either of two ends thereof in the long tube or short tube to hold a double-head screwdriver tip outside the handle shells for turning screws.

4 Claims, 9 Drawing Sheets

REVERSIBLE RATCHET SCREWDRIVER

BACKGROUND OF THE INVENTION

The present invention relates to reversible ratchet screwdrivers, and more particularly to such a reversible ratchet screwdriver, which can be equipped with four tip means for turning four different types of screws.

In modern times, skilled labor is scarce. Therefore, the cost to hide a skilled labor, for example, a carpenter or electrician, is quite expensive. For small repairing works such as electric outlets, fuse, water valve, toilet accessories, one may do by oneself instead of asking a skilled labor. Most families have a variety of hand tools for use in different repair works, or for setting up DIY (do-it-yourself) furniture. A screwdriver is one of the most commonly used hand tools for turning screws. A regular screwdriver is comprised of a handle, and a blade fixedly connected to the handle for turning a particular type of screws. This structure of screwdriver is not reversible, and the operator shall have to spend much labor when turning a screw. In order to eliminate this problem, reversible ratchet screwdrivers are developed. FIGS. 1 through 3B show a reversible ratchet screwdriver according to the prior art. This structure of reversible ratchet screwdriver comprises a handle, a ratchet mechanism mounted in the handle, a socket coupled to the ratchet mechanism for holding a screwdriver tip for turning screws, and a switch controlled to shift the ratchet mechanism between a first position and a second position. When at the first position, the socket is rotated with the handle when the handle is rotated clockwise, or stands idle when the handle is rotated counter-clockwise. When at the second position, the socket stands idle when the handle is rotated clockwise, or rotated with the handle when the handle is rotated counter-clockwise. This structure of reversible ratchet screwdriver is functional, however the socket has only one working end for holding a particular screwdriver tip. As illustrated in FIG. 2, only one screwdriver tip, which has a first working tip portion at one end and a second working tip portion at an opposite end, can be installed in the socket for turning screws. Therefore, the user shall have to carry different types of screwdriver tips separately. Further, when operating the reversible ratchet screwdriver, the switch tends to be switched, causing an error in operation.

SUMMARY OF THE INVENTION

The present invention has been accomplished to provide a reversible ratchet screwdriver, which eliminates the aforesaid drawbacks. It is one object of the present invention to provide a reversible ratchet screwdriver, which can be set between two alternate arrangements to fit left-handed reversible operation or right-handed reversible operation as desired. It is another object of the present invention to provide a reversible ratchet screwdriver, which uses a double-head socket to hold two double-head screwdriver tips for turning different screws. To achieve these and other objects of the present invention, there is provided a reversible ratchet screwdriver, which comprises a top handle shell and a bottom handle shell fastened together, a ratchet mechanism mounted inside the handle shells, the ratchet mechanism comprising a substantially triangular flat block, a long tube and a short tube formed integral with top and bottom sides of the triangular flat block and longitudinally communicated with each other, three pawls respectively coupled between the triangular flat block and a toothed portion at the bottom handle shell, and three spring elements respectively connected between the triangular flat block and the pawls to force the pawls into engagement with the toothed portion at the bottom handle shell, and a socket for mounting in the long tube or short tube to hold a screwdriver tip for turning screws. The socket is a double-head socket having two hexagonal receptacle portions at two distal ends thereof for holding a double-head screwdriver tip respectively. A double-head screwdriver tip comprises two different tip portions at two opposite ends for turning different types of screws, for example, the screwdriver tip can have a cabinet tip portion at one end and a Phillips head tip portion at an opposite end. By shifting the socket between the long tube and the short tube, the reversible direction of the reversible ratchet screwdriver is relatively changed.

DETAILED DESCRIPTION OF THE PREFERRED EMBODIMENT

Figure 1:
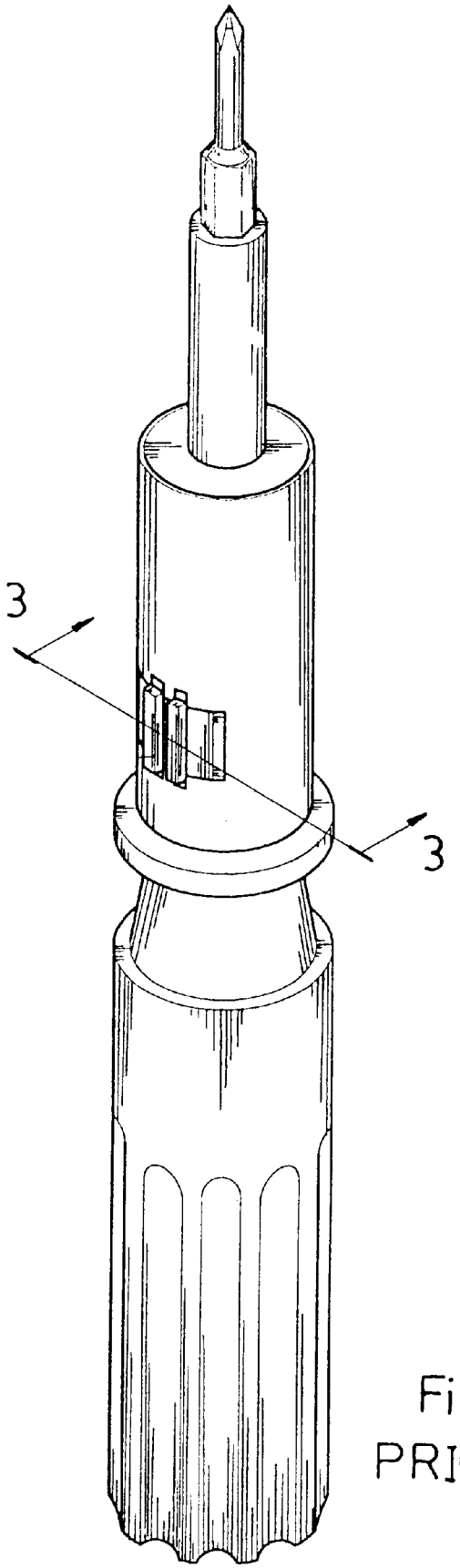
Fig 1 PRIOR ART
FIG. 1 is an elevational view of a reversible ratchet screwdriver according to the prior art.
Figure 2:
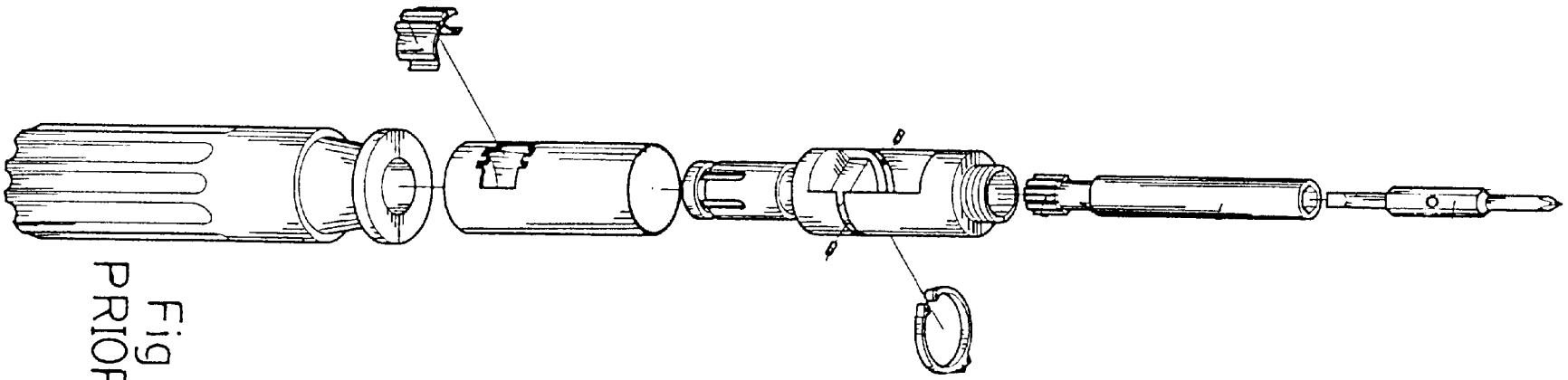
Fig 2 PRIOR ART
FIG. 2 is an exploded view of the reversible ratchet screwdriver shown in FIG. 1.
Figure 3A:
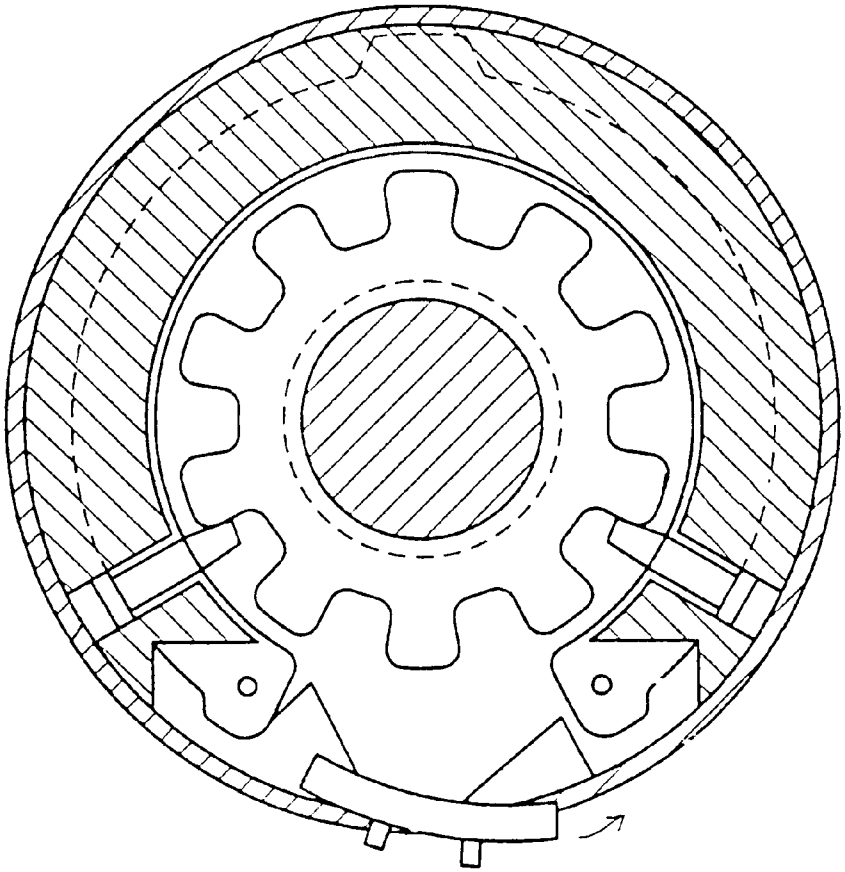
Fig 3A PRIOR ART
FIG. 3A is a sectional view in an enlarged scale taken along line 3—3 of FIG. 1.
Figure 3B:
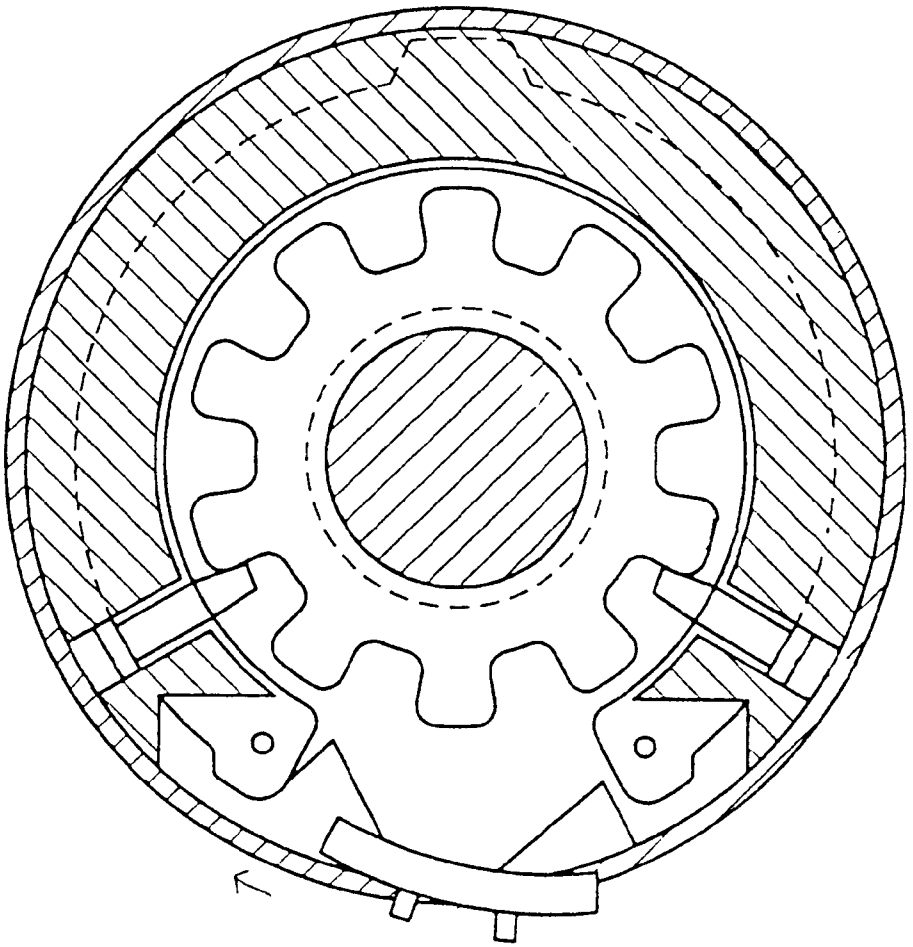
Fig 3B PRIOR ART
FIG. 3B is similar to FIG. 3A but showing the reversible ratchet screwdriver switched to the other direction.

Referring to Figures from 4 through 8, a reversible ratchet screwdriver is shown comprised of a top handle shell 10, a bottom handle shell 20, a ratchet mechanism 30 mounted in between the top handle shell 10 and the bottom handle shell 20, and a double-head socket 40. The double-end socket 40 is inserted with either of its two opposite ends into the ratchet mechanism 30. The two opposite ends of the double-head socket 40 are designed to hold a screwdriver tip 50 respectively. The top handle shell 10 and the bottom handle shell 20 are hollow, symmetrical shells, and can be fastened together, forming an egg-like handle. The handle shells 10 and 20 have a respective coupling flange 11 or 21 at one end coupled to each other, and then fixedly sealed together by a high frequency welding apparatus, and a respective center through hole 12 or 22 axially aligned for receiving the double-end socket 40. An embossed handhold portion 13 or 23 is provided around the outside wall of the handle shell 10 or 20 near its coupling flange 11 or 21. A toothed portion 24 is provided around the inside wall of the bottom handle shell 20 near its coupling flange 21.

The ratchet mechanism 30 comprises a substantially triangular flat block 31, a long tube 313 and a short tube 314 formed integral with top and bottom sides of the triangular flat block 31 and longitudinally communicated with each other, three pawls 32 respectively coupled between the triangular flat block 31 and the toothed portion 24 at the bottom handle shell 20, and three spring elements, for example, compression springs 33 respectively connected between the triangular flat block 31 and the pawls 32 to force the pawls 32 into engagement with the toothed portion 24 at the bottom handle shell 20. The triangular flat block 31 has three leftwardly and downwardly extended retaining notches 311 at the three angles thereof, and three bearing surface portions 312 respectively provided in the retaining notches 311 at one side. The pawls 32 each comprises a toothed portion 321 at one end meshed with the toothed portion 24 at the bottom handle shell 20, a cylindrical coupling portion 322 at an opposite end respectively and axially inserted into the retaining notches 311 at the triangular flat block 31 from the bottom and then coupled thereto, a flat supporting portion 323 on the middle, and a stub rod 324 raised from the flat supporting portion 323. The long tube 313 and the short tube 314 each have a plurality of longitudinal coupling grooves 315 symmetrically provided on the inside, and a recessed hole 316 provided on the inside. The compression springs 33 each have one end mounted on the stub rod 324 at one pawl 32 and supported on the flat supporting portion 323 at the corresponding pawl 32, and an opposite end stopped against one bearing surface portion 312 at the triangular flat block 31. The compression springs 33 push the pawls 32 outwards from the triangular flat block 31, forcing the pawls 32 into engagement with the toothed portion 24 at the bottom handle shell 20.

The double-end socket 40 comprises two hexagonal receptacle portions 41 at its two distal ends for holding a screwdriver tip 50 respectively, a plurality of longitudinal ribs 42 symmetrically raised from the outside wall thereof for engaging into the longitudinal coupling grooves 315 at the long tube 313 or the short tube 314, and a spring supported steel ball 43 mounted in a hole (not shown) on the periphery thereof and partially projecting out of the periphery for engaging into the recessed hole 316 inside the long tube 313 or the short tube 314. A screwdriver tip 50 in accordance with the present invention is a double head tip having two different tip portions at two opposite ends for turning different types of screws, for example, the screwdriver tip can have a cabinet tip portion at one end and a Phillips head tip portion at an opposite end. Because the socket 40 has two hexagonal receptacle portions 41 at its two distal ends, two different screwdriver tips 50 can be mounted in the hexagonal receptacle portions 41 at the socket 40.

Figure 4:
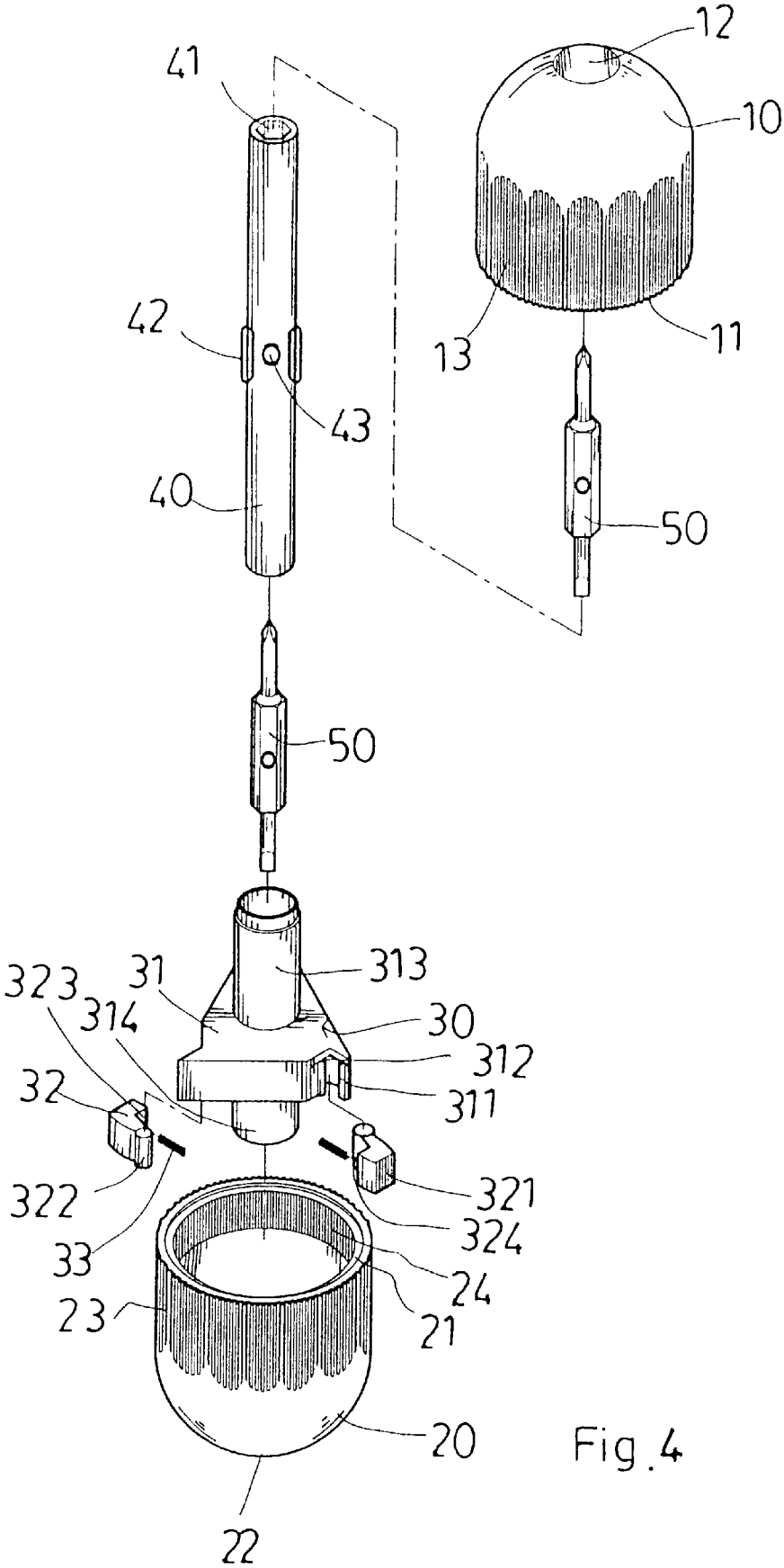
FIG. 4 is an exploded view of a reversible ratchet screwdriver according to the present invention.
Figure 5:
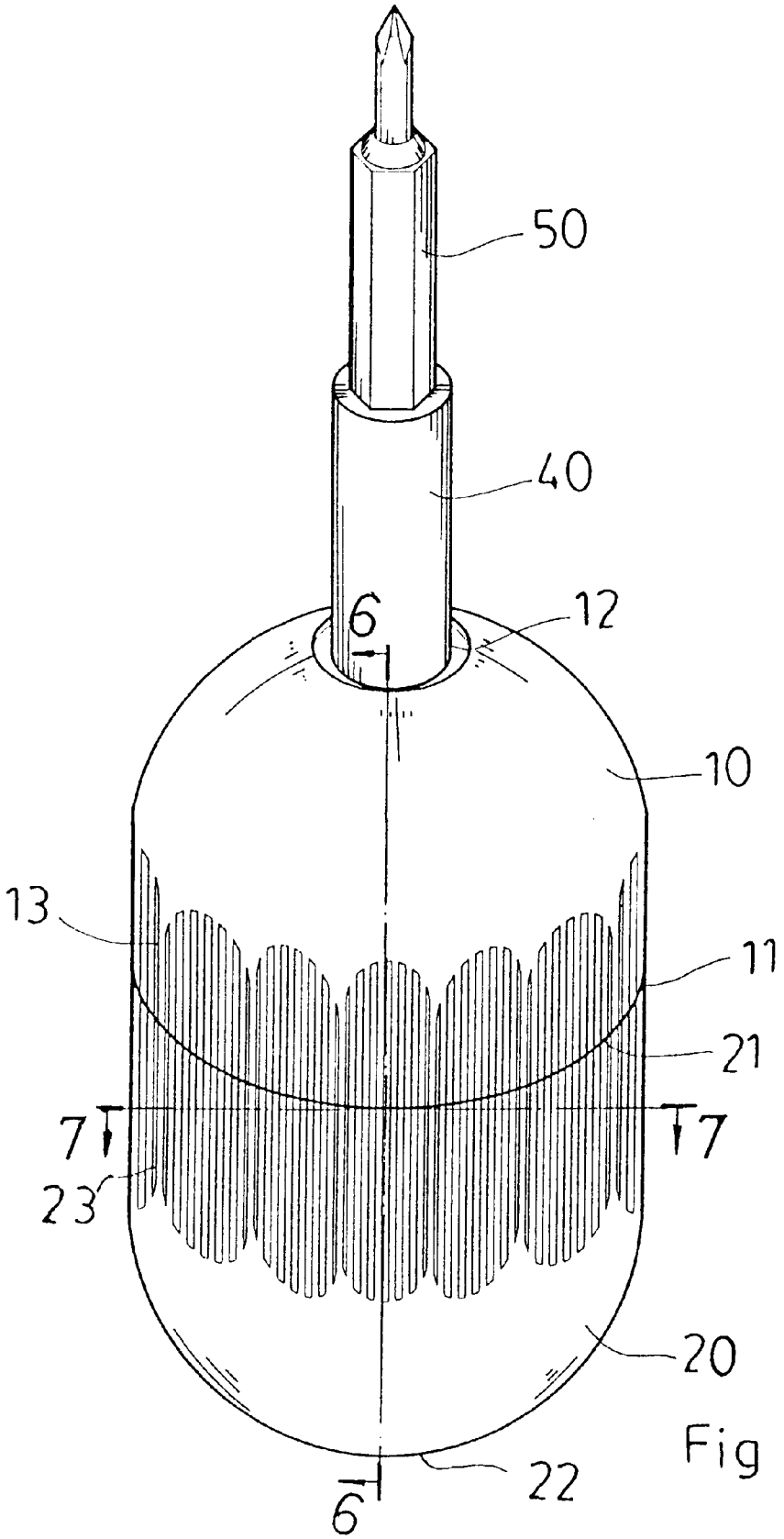
FIG. 5 is a perspective assembly view in an enlarged scale of the reversible ratchet screwdriver shown in FIG. 4.
Figure 6:
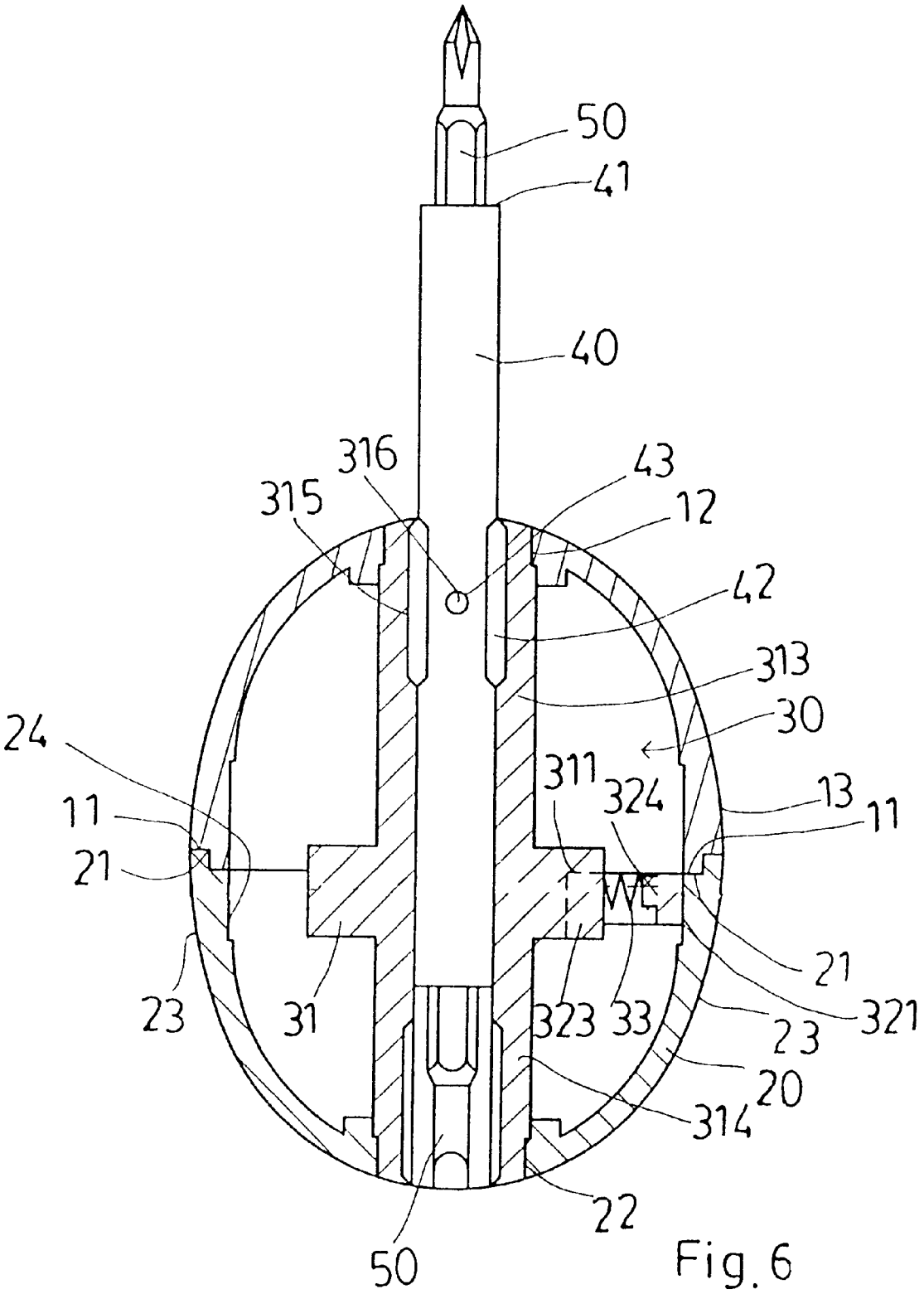
FIG. 6 is a sectional view taken along line 6—6 of FIG. 5.

Referring to FIGS. 4, 5 and 6 again, the pawls 32 are respectively coupled to the triangular flat block 30 by inserting the cylindrical coupling portion 322 of each pawl 32 into the retaining notches 311 at the triangular flat block 31 from the bottom, then the compression springs 33 are respectively mounted on the stub rod 324 at each pawl 32 and respectively supported between the flat supporting portion 323 at each pawl 32 and the bearing surface portions 312 at the triangular flat block 31, and then the triangular flat block 30 together with the compression springs 33 and the pawls 32 are inserted into the bottom handle shell 20, permitting the pawls 32 to be forced by the compression springs 33 into engagement with the toothed portion 24 inside the bottom handle shell 20, and then the top handle shell 10 is covered on the bottom handle shell 20, enabling the coupling flanges 11 and 21 to be coupled to each other, and the long tube 313 and short tube 314 to be axially connected between the center through hole 12 at the top handle shell 10 and the center through hole 22 at the bottom handle shell 20, and then the connecting area between the top handle shell 10 and the bottom handle shell 20 is sealed by a high frequency welding apparatus, and then the double-head socket 40 is inserted into the center through hole 12 at the top handle shell 10 and the long tube 313 at the triangular flat block 31, or the center through hole 22 at the bottom handle shell 20 and the short tube 314 at the triangular flat block 31 by engaging the longitudinal ribs 42 and spring-supported steel ball 43 of the double-head socket 40 into the longitudinal coupling grooves 315 and recessed hole 316 at the long tube 313 or short tube 314. When installed, one hexagonal receptacle portion 41 of the double-head socket 40 is extended out of the top handle shell 10 or bottom handle shell 20, and the other hexagonal receptacle portion 41 of the double-headed socket 40 is received inside the handle shells 10 and 20 without hinder of the gripping of the hand on the handle shells 10 and 20.

Figure 7:
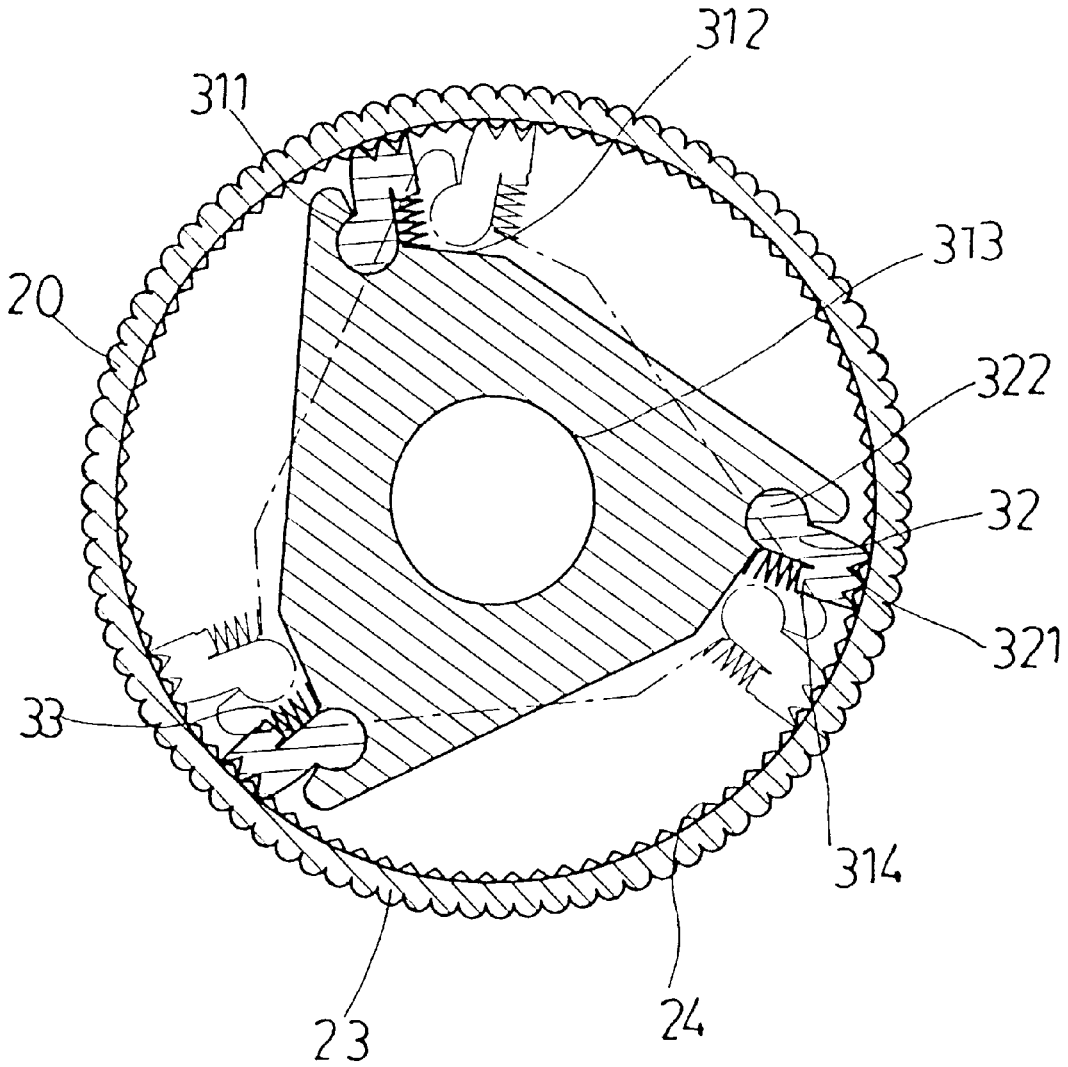
FIG. 7 is a sectional view in an enlarged scale taken along line 7—7 of FIG. 5.
Figure 8:
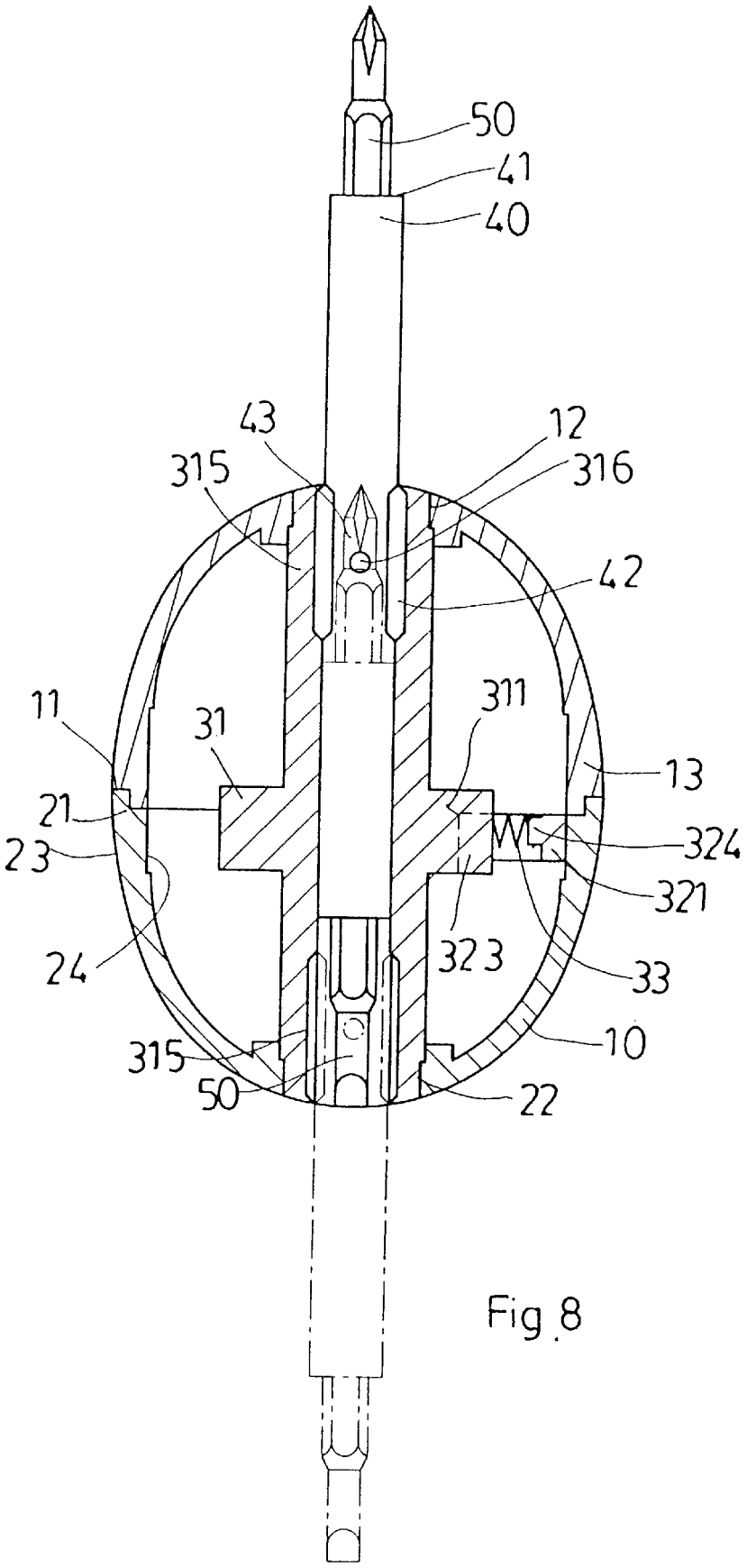
FIG. 8 shows an application example of the present invention.

Referring to FIGS. 7 and 8, because the retaining notches 311 at the triangular flat block 30 are respectively extended leftwardly, the pawls 32 are allowed to be moved leftwardly. If the double-head socket 40 is installed in the top handle shell 10, the double-head socket 40 and the triangular flat block 30 will be rotated with the handle shells 10 and 20 when rotating the handle shells 10 and 20 clockwise, and the double-head socket 40 will stand idle when rotating the handle shells 10 and 20 counter-clockwise (see FIG. 7). On the contrary, if the double-head socket 40 is installed in the bottom handle shell 20, the double-head socket 40 and the triangular flat block 30 will stand idle when rotating the handle shells 10 and 20 clockwise, and the double-head socket 40 and the triangular flat block 30 will be rotated with the handle shells 10 and 20 when rotating the handle shells 10 and 20 counter-clockwise.

As indicated above, the reversible ratchet screwdriver of the present invention achieves the following advantages:

1. Because two different specifications of screwdriver tips 50 can be stored in the double-head socket 40 and, because each screwdriver tip has two different tip portions at two opposite ends for turning different types of screws, the user needs not to carry a big number of screwdriver tips.
2. When the double-head socket 40 is installed, one hexagonal receptacle portion 41 of the double-head socket 40 is extended out of the top handle shell 10 or bottom handle shell 20, and the other hexagonal receptacle portion 41 of the double-headed socket 40 is received inside the handle shells 10 and 20 without hindering the gripping of the hand on the handle shells 10 and 20.
3. Because the retaining notches 311 at the triangular flat block 30 extend leftwardly, the paws 32 are allowed to be moved in one direction only, and the reversible screwdriver works when rotated in one direction, or runs idle when rotated in the reversed direction.

What is claimed is:

1. A reversible ratchet screwdriver comprising:

a handle formed of a top handle shell and a bottom handle shell fastened together, said top handle shell and said bottom handle shell each having a center through hole axially aligned, said bottom handle shell comprising a toothed portion around an inside wall thereof;

a ratchet mechanism mounted inside said handle, said ratchet mechanism comprising a substantially triangular flat block, a long tube and a short tube formed integral with top and bottom sides of said triangular flat block and longitudinally communicated with each other, three pawls respectively coupled between said triangular flat block and the toothed portion at said bottom handle shell, and three spring elements respectively connected between said triangular flat block and said pawls to force said pawls into engagement with the toothed portion at said bottom handle shell, said triangular flat block comprising three leftwardly and downwardly extended retaining notches at three angles thereof, and three bearing surface portions respectively provided in said retaining notches at one side, said pawls each comprising a toothed portion at one end meshed with the toothed portion at said bottom handle shell, a cylindrical coupling portion at an opposite end respectively coupled to the retaining notches at said triangular flat block, a flat supporting portion on the middle, and a stub rod raised from said flat supporting portion, said spring elements each having one end respectively mounted on the stub rod and supported on the flat supporting portion at each of said pawls and an opposite end respectively stopped against the bearing surface portions at said triangular flat block; and a double-head socket for mounting in the center through hole at said top handle shell or the center through hole at said bottom handle shell for turning with said handle to rotate screws with a screwdriver tip installed therein; wherein when said double-head socket is mounted with one of two ends thereof in one of said long tube and said short tube, said double-head socket is rotated with said ratchet mechanism when rotating said top and bottom handle shells with the hand in one direction, or stands idle when rotating said top and bottom handle shells with the hand in the reversed direction.

2. The reversible ratchet screwdriver of claim 1 wherein said bottom handle shell comprises a coupling flange at a top end thereof, and said top handle shell comprises a coupling flange raised from a bottom end thereof and coupled to the coupling flange at said bottom handle shell and sealed by a high frequency welding apparatus.

3. The reversible ratchet screwdriver of claim 1 wherein said top handle shell and said bottom handle shell each have an embossed portion around the periphery thereof near the connecting area therebetween.

4. The reversible ratchet screwdriver of claim 1 wherein said long tube and said short tube each have a plurality of longitudinal coupling grooves symmetrically provided on the inside for the positioning of said double-head socket, and a recessed hole provided on the inside for securing said double-head socket in position; said double-end socket comprises two hexagonal receptacle portions at two distal ends for holding a double-head screwdriver tip respectively, said double-head screwdriver tip having two different tip portions at two opposite ends thereof for turning different types of screws, a plurality of longitudinal ribs symmetrically raised from the periphery thereof for engaging into the longitudinal coupling grooves at one of said long tube and said short tube, and a spring supported steel ball mounted in a hole on the periphery and partially projecting out of the periphery for engaging into the recessed hole inside one of said long tube and said short tube.

* * * * *